US007736212B2

(12) United States Patent
Willinger

(10) Patent No.: US 7,736,212 B2
(45) **Date of Patent: *Jun. 15, 2010**

(54) MOUNTING ARRANGEMENT FOR SQUEAKERS

(75) Inventor: Jon Willinger, Tenafly, NJ (US)

(73) Assignee: J.W. Pet Company, Inc., Teterboro, NJ (US)

( * ) Notice: Subject to any disclaimer, the term of this patent is extended or adjusted under 35 U.S.C. 154(b) by 729 days.

This patent is subject to a terminal disclaimer.

(21) Appl. No.: 11/312,071

(22) Filed: Dec. 20, 2005

(65) Prior Publication Data

US 2006/0099878 A1 May 11, 2006

Related U.S. Application Data

(63) Continuation of application No. 10/889,962, filed on Jul. 13, 2004, now Pat. No. 7,066,779.

(51) Int. Cl.
*A63H 3/28* (2006.01)
*A01K 29/00* (2006.01)

(52) U.S. Cl. ..... 446/184; 119/707

(58) Field of Classification Search ..... 446/183, 446/184, 188; 119/707, 709, 711
See application file for complete search history.

(56) References Cited

U.S. PATENT DOCUMENTS

| | | | |
|---|---|---|---|
| 754,148 | A | 3/1904 | Kuhlemann |
| 1,187,838 | A | 6/1916 | Hughes |
| 1,612,651 | A | 12/1926 | Thomas |
| 1,668,785 | A | 5/1928 | Smart |
| 2,631,407 | A | 3/1953 | Rempel |
| 2,712,201 | A | 7/1955 | Wintriss |
| 2,714,275 | A | 8/1955 | Proll |
| 2,734,309 | A | 2/1956 | Seaver |
| 2,745,214 | A | 5/1956 | Lawson |
| 2,763,960 | A | 9/1956 | Wintriss |
| 2,777,252 | A | 1/1957 | Tancredi et al. |
| 2,817,116 | A | 12/1957 | Miller et al. |
| 2,975,550 | A | 3/1961 | Miller |
| 3,075,317 | A | 1/1963 | Craft |
| 3,702,038 | A | 11/1972 | Hakim |
| 3,956,850 | A | 5/1976 | Seidenberg |
| RE29,050 | E | 11/1976 | Hakim |
| 4,253,254 | A | 3/1981 | Gill |
| 4,380,134 | A | 4/1983 | Taluba et al. |
| 4,506,468 | A | 3/1985 | Willhite |
| 4,779,344 | A | 10/1988 | Panisch |
| 5,113,784 | A | 5/1992 | Forselius |
| 5,267,885 | A | 12/1993 | Niskern et al. |

(Continued)

*Primary Examiner*—John Ricci
(74) *Attorney, Agent, or Firm*—Katten Muchin Rosenman LLP

(57) ABSTRACT

A method of mounting a squeaker into a hard rubber ball toy. A separate holder or sleeve is provided that retains a squeaker and forms the noise producing element to be inserted into the rubber toy. The sleeve has a recessed area that tightly mates with an opening in the rubber toy and also includes a bonding surface to secure the sleeve to the toy. The sleeve could also be formed with fin members that extend orthogonally from a distal end of the sleeve. The total width of the sleeve and the associated fin members is such that it complies with consumer product safety requirements. An inherent feature of the disclosed structure is that the fin members will cause the noise producing element to be retained within the toy even if the bonding of the sleeve to the opening in the toy happens to fail.

19 Claims, 5 Drawing Sheets

U.S. PATENT DOCUMENTS

| | | | | |
|---|---|---|---|---|
| 6,112,703 | A | 9/2000 | Handelsman | |
| 6,216,640 | B1 | 4/2001 | Zelinger | |
| 6,413,139 | B1 | 7/2002 | Douglas | |
| 6,609,944 | B1 | 8/2003 | Viola | |
| 6,881,120 | B1 | 4/2005 | Janes | |
| 6,935,274 | B1 | 8/2005 | Rothschild | |
| 7,066,779 | B2 * | 6/2006 | Willinger | 446/188 |
| 7,201,117 | B2 | 4/2007 | Ritchey | |
| 7,343,878 | B2 | 3/2008 | Ritchey | |
| 2001/0008125 | A1 | 7/2001 | Mann | |
| 2002/0102912 | A1 | 8/2002 | Duval | |
| 2007/0245976 | A1 | 10/2007 | Ritchey | |

* cited by examiner

MOUNTING ARRANGEMENT FOR SQUEAKERS

RELATED APPLICATIONS

The present application is a continuation of and claims priority to U.S. Ser. No. 10/889,962 filed on Jul. 13, 2004 now U.S. Pat. No. 7,066,779, which is hereby incorporated in its entirety for all purposes.

BACKGROUND OF THE INVENTION

1. Field of Invention

The present invention relates generally to the field of toys. More specifically, the present invention is related to a toy including a squeaker and method of mounting the squeaker into the toy.

2. Discussion of Prior Art

Generally, inserting a noise producing element into a Figure or ball toy is well known. U.S. Pat. Nos. 754,148, 1,187,838, 1,668,785, RE29050, 3,075,317 and 3,702,038 show such devices.

As far as mounting arrangements go, in the case of vinyl material, as shown in FIG. 1*a* and FIG. 1*b*, the mounting of the squeaker mechanism into a toy is commonly done by molding an opening into the material. A common fitting is inserted into this opening. When bonded this fitting creates a slight whistling sound which could stand alone as a noise element. A barbed squeaker can then be forced into the fitting for a true squeak sound. And for latex material, as shown in FIG. 1*c*, a ribbed mound of material is created with a rough through-hole into which a barbed squeaker is inserted.

The prior art fails to provide squeakers utilizing a separate holder for gluing to a rubber toy. Also, none of the prior art squeakers have the present invention method for complying with child safety standards.

Whatever the precise merits, features, and advantages of the above cited references, none of them achieves or fulfills the purposes of the present invention.

SUMMARY OF THE INVENTION

The present invention includes a mounting arrangement for a squeaker into a rubber ball toy. The squeaker mechanism is trapped within a polystyrene or rubber sleeve to form a noise producing element. The sleeve has a recessed area that tightly mates with an opening in the rubber toy and also includes a bonding surface to secure the sleeve to the toy.

In an alternative embodiment, the sleeve also has fin members that extend orthogonally from a distal end of the sleeve. The total width of the sleeve and the associated fin members is such that it complies with consumer product safety requirements. The fin members make the sleeve substantially larger than the opening in the toy such that it is inherent in the structure that the sleeve and squeaker will fall into the toy if the bond holding the sleeve to the toy happens to fail.

DESCRIPTION OF THE PREFERRED EMBODIMENTS

Figure 1A:
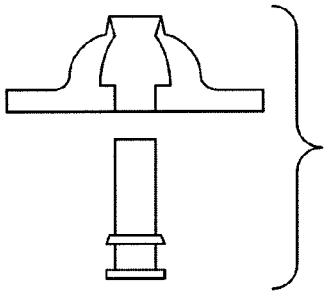
FIG. 1A PRIOR ART
FIG. 1*a* illustrates a prior art common fitting inserted into an opening molded into the vinyl.
Figure 1B:
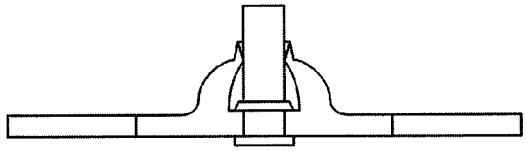
FIG. 1B PRIOR ART
FIG. 1*b* illustrates a prior art method of inserting squeaker into a common fitting.
Figure 1C:
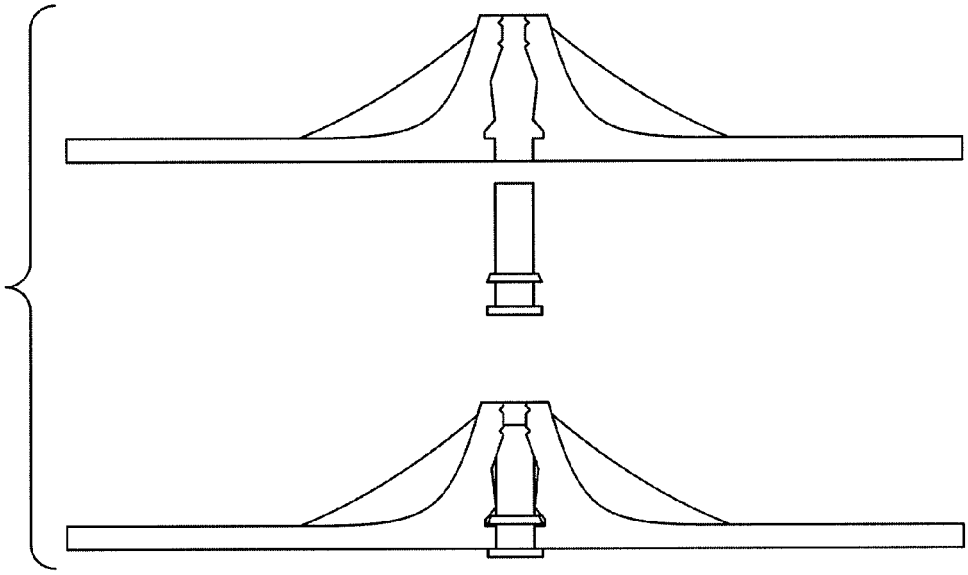
FIG. 1C PRIOR ART
FIG. 1*c* illustrates a prior art method of inserting squeaker into a rough through-hole.

While this invention is illustrated and described in a preferred embodiment, the device may be produced in many different configurations, forms and materials. There is depicted in the drawings, and will herein be described in detail, a preferred embodiment of the invention, with the understanding that the present disclosure is to be considered as an exemplification of the principles of the invention and the associated functional specifications for its construction and is not intended to limit the invention to the embodiment illustrated. Those skilled in the art will envision many other possible variations within the scope of the present invention.

Figure 2A:
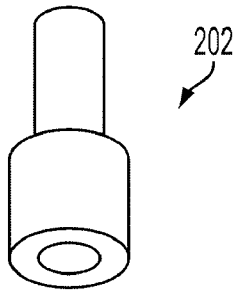
FIG. 2*a* illustrates a typical squeaker mechanism.
Figure 2B:
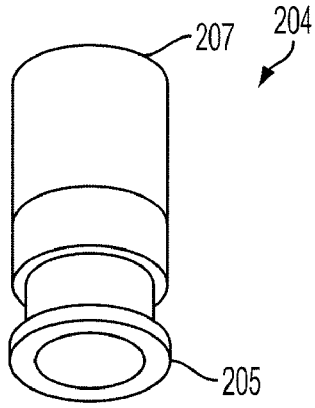
FIG. 2*b* illustrates a rubber sleeve to hold squeaker mechanism.
Figure 2C:
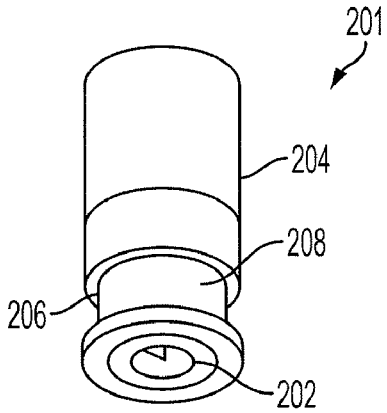
FIG. 2*c* illustrates squeaker mechanism retained in a sleeve and the rubber sleeve including a gluing surface.

FIG. 2*a* shows a typical squeaker mechanism 202. According to a preferred embodiment, FIG. 2*b* shows rubber sleeve 204 with proximate and distal ends 205, 207 respectively. Noise producing element 201 as shown in FIG. 2*c*, is formed by engaging squeaker 202 with sleeve 204 such that squeaker 202 is retained within sleeve 204. The squeaker made from oliphanic material such as polypropylene or polyethylene, is placed into a sleeve that is styrenic and therefore provides a better bonding surface than the squeaker by itself.

Figure 3:
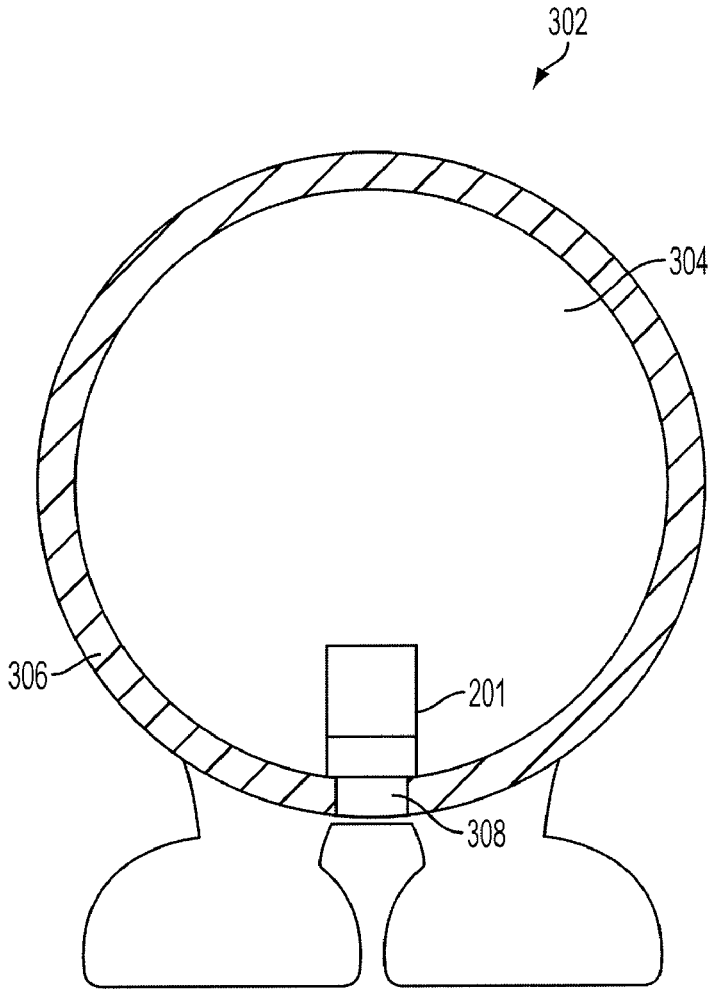
FIG. 3 illustrates mounting arrangement of squeaker in rubber ball.

Referring now to FIG. 3, rubber toy 302 is fashioned of thick-walled heavy-duty rubber. The toy is formed with a hollow body 304 and an outer shell 306. The outer shell is, for example, 2" in diameter. The toy comprises an opening 308 through which the squeaker trapped in a rubber sleeve is inserted. Going back to FIG. 2*c*, the rubber sleeve is utilized as a separate holder for the squeaker and is provided with a bonding surface 208 that aids in the securing of the sleeve to the toy. The sleeve has recessed area 206 that tightly mates with opening 308 in the rubber toy and is bonded to the toy with cyanoacrylate. Please note that functionally equivalent squeaker materials, sleeve materials and bonding agents may be used without departing from the scope of the present invention.

Figure 4A:
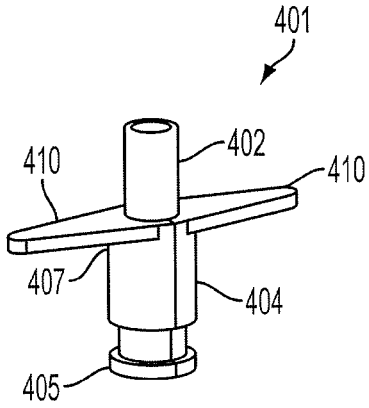
FIG. 4*a* illustrates a squeaker mechanism retained in a polystyrene sleeve.
Figure 4B:
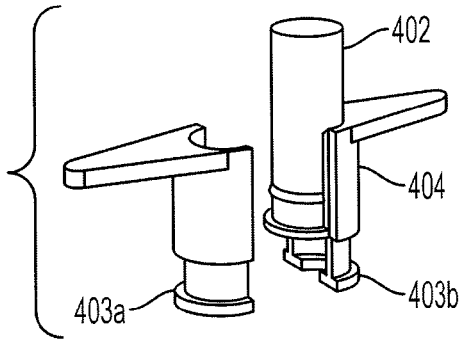
FIG. 4*b* illustrates a sleeve composed of two half shells and extending fins.
Figure 4C:
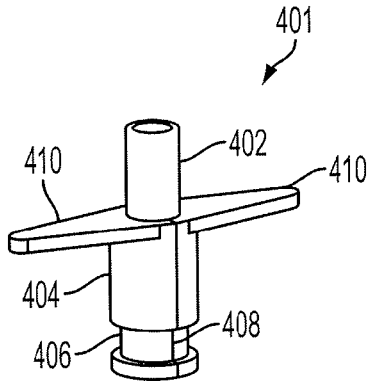
FIG. 4*c* illustrates a sleeve including a gluing surface.

FIGS. 4*a*, 4*b*, 4*c* illustrate a second embodiment of the present invention. FIG. 4*a* shows squeaker 402 retained in polystyrene sleeve 404, with proximate and distal ends 405, 407 respectively, forming noise producing element 401. Sleeve 404 as shown in FIG. 4*b* is composed of two half shells 403*a*, 403*b* to be secured together.

In order to pass the Consumer Product Safety Commission standard for small children, the sleeve size of the present invention must not fall into a 1¼ inch aperture. Therefore to meet the safety ratings, preferably by a ½" diameter, sleeve 404 also includes integral extended members or fins 410 which are orthogonal to squeaker 402 to expand the total width of the sleeve. Please note that fins 410, in an alternative embodiment, may follow the curvature of the inner surface of the small toy.

Figure 5:
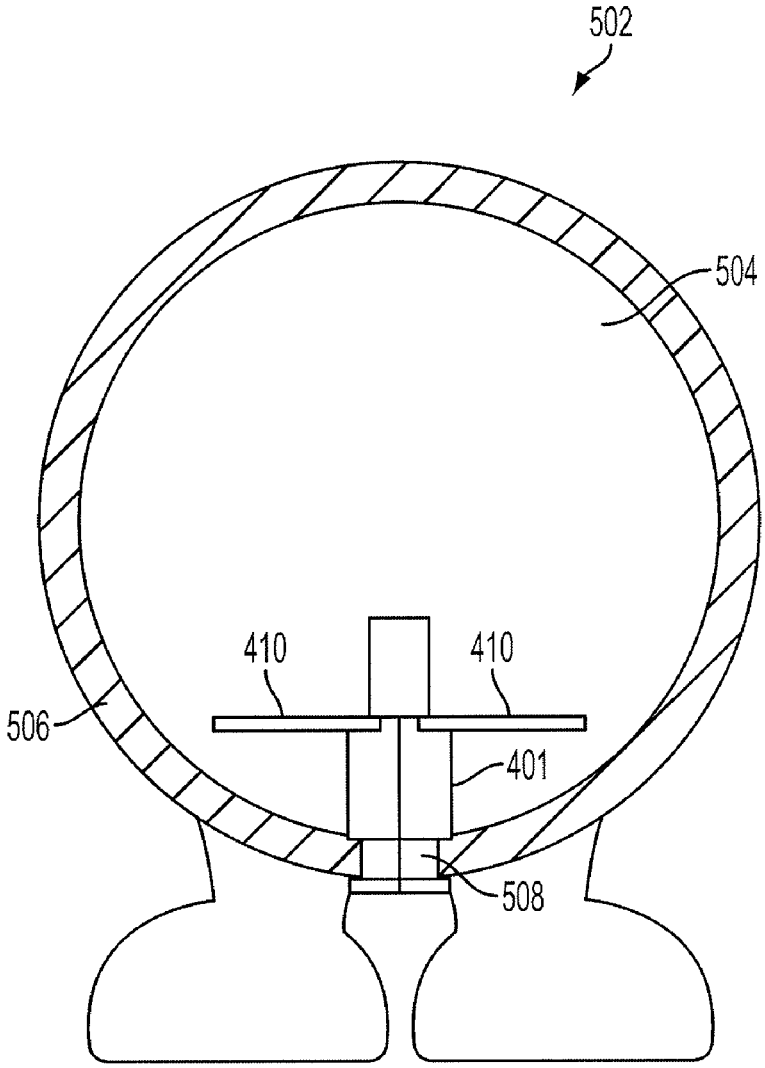
FIG. 5 illustrates mounting arrangement of squeaker in a rubber ball.

Referring to FIG. 5, rubber toy 502 is similar in structure to rubber toy 302 of FIG. 3. The toy is formed with a hollow body 504 and outer shell 506. The outer shell is, for example, 3" in diameter. Sleeve 404 acts as a better bonding surface than squeaker 402. As shown in FIG. 4*c*, recessed area 406 integral to the sleeve mates with an opening 508 in the rubber toy 302. Sleeve 404 including bonding surface 408 secures the sleeve to the rubber toy with cyanoacrylate. Please note that a bigger sized squeaker (with sleeve) could be mounted into a correspondingly bigger toy in a similar manner so as to still provide for the requirements of consumer product safety rating as described above.

As shown in FIG. 5, note that the total width of the sleeve 404 (including the fins 410) is substantially larger than the opening 508 in the rubber toy 302. Thus, it is inherent in the above described structure that even if the cyanoacrylate (or other bonding agent) holding the sleeve 404 to the rubber toy 302 should happen to fail, the sleeve 404 and the squeaker 402 would be retained within the rubber toy 302. That is to say, the sleeve structure that includes the integral fins 410 disclosed in FIG. 5 is inherently adapted to cause the sleeve 404 and the squeaker 402 to fall into the rubber toy 302 (as opposed to falling out of the rubber toy 302) if the bond between the bonding surface 408 of the sleeve 404 separates from the opening 508 in the rubber toy 302.

CONCLUSION

A system and method has been shown in the above embodiments for the effective implementation of mounting arrangement for squeakers. While various preferred embodiments have been shown and described, it will be understood that there is no intent to limit the invention by such disclosure, but rather, it is intended to cover all modifications and alternate constructions falling within the spirit and scope of the invention, as defined in the appended claims. For example, the present invention should not be limited by size, materials, or specific manufacturing techniques.

What is claimed is:

1. A noise producing toy structure comprising:
at least an outer shell;
an opening in said outer shell to accommodate a noise producing element; and
said noise producing element comprising:
a sleeve comprising proximate and distal ends;
means for securing the sleeve within said opening;
a squeaker retained within said sleeve,
wherein the sleeve is separate and is adapted to cause the noise producing element to be retained within the outer shell if the means for securing fails,
wherein said sleeve includes at least one member extending from said distal end.

2. A noise producing toy structure, according to claim 1, wherein said means for securing includes a bonding agent.

3. A noise producing toy structure, according to claim 2, wherein said bonding agent includes cyanoacrylate.

4. A noise producing toy structure, according to claim 1, wherein the at least one member extends orthogonally from the sleeve.

5. A noise producing toy structure, according to claim 1, wherein the at least one member extends from the sleeve following a curvature of an inner surface of said toy structure.

6. A noise producing toy structure, according to claim 1, wherein the at least one member causes the noise producing element to be retained within the outer shell if the means for securing fails.

7. A noise producing toy structure, according to claim 1, wherein the at least one member prevents the noise producing element from being removed from the outer shell.

8. A noise producing toy structure, according to claim 1, wherein the at least one member causes the noise producing element to become trapped within the outer shell if the means for securing fails.

9. The noise producing toy structure of claim 1, wherein the at least one member extending from the distal end is rigid.

10. The noise producing toy structure of claim 1, wherein a portion of the sleeve within the outer shell has a uniform outer cross-sectional diameter except at the at least one member extending from the distal end.

11. A noise producing mechanism retained in a hollow body comprising:
a sleeve including a proximate end, a distal end, and at least one member extending from the distal end, wherein the sleeve is secured within an opening in said hollow body; and
a squeaker retained within said separate sleeve,
wherein the least one member extending from the distal end is adapted to retain the noise producing mechanism within the hollow body if the sleeve becomes unsecured from the opening in the hollow body.

12. A noise producing mechanism retained in a hollow body, according to claim 11, wherein said at least one member extending from the distal end includes a plurality of fin members extending orthogonally from the distal end of said sleeve.

13. A noise producing mechanism retained in a hollow body, according to claim 11, wherein said at least one member extending from the distal end includes a plurality of fin members shaped to follow the curvature of an inner surface of said hollow body.

14. A noise producing mechanism retained in a hollow body, according to claim 11, wherein said sleeve is made of styrenic material.

15. A noise producing mechanism retained in a hollow body, according to claim 11, wherein said hollow body is a rubber ball.

16. A noise producing mechanism retained in a hollow body, according to claim 11, wherein said hollow body is a rubber squeeze Figure toy.

17. A noise producing mechanism retained in a hollow body, according to claim 11, wherein said hollow body is a pet toy.

18. The noise producing toy structure of claim 11, wherein the at least one member extending from the distal end is rigid.

19. The noise producing toy structure of claim 11, wherein a portion of the sleeve within the outer shell has a uniform outer cross-sectional diameter except at the at least one member extending from the distal end.

* * * * *